US009752215B2

(12) United States Patent
Reynolds et al.

(10) Patent No.: US 9,752,215 B2
(45) Date of Patent: Sep. 5, 2017

(54) SUPERALLOY COMPOSITIONS, ARTICLES, AND METHODS OF MANUFACTURE

(75) Inventors: Paul L. Reynolds, Tolland, CT (US); Jerry C. Capo, Greensburg, PA (US); Darryl Slade Stolz, Newington, CT (US)

(73) Assignee: United Technologies Corporation, Farmington, CT (US)

( * ) Notice: Subject to any disclaimer, the term of this patent is extended or adjusted under 35 U.S.C. 154(b) by 74 days.

(21) Appl. No.: 13/372,590

(22) Filed: Feb. 14, 2012

(65) Prior Publication Data

US 2013/0209266 A1 Aug. 15, 2013

(51) Int. Cl.

| | |
|---|---|
| ***C22C 19/05*** | (2006.01) |
| ***C22C 1/04*** | (2006.01) |
| ***C22C 30/00*** | (2006.01) |
| ***C22F 1/10*** | (2006.01) |
| ***B22F 5/00*** | (2006.01) |

(52) U.S. Cl.

CPC ..... *C22C 19/056* (2013.01); *B22F 5/009* (2013.01); *C22C 1/0433* (2013.01); *C22C 19/057* (2013.01); *C22C 30/00* (2013.01); *C22F 1/10* (2013.01); *B22F 2998/10* (2013.01)

(58) Field of Classification Search

CPC ..... C22C 19/056; C22C 19/057
USPC ..... 420/441–460; 419/10
See application file for complete search history.

(56) References Cited

U.S. PATENT DOCUMENTS

| | | | |
|---|---|---|---|
| 3,061,426 A | 10/1962 | Bieber | |
| 4,209,348 A | 6/1980 | Duhl et al. | |
| 4,569,824 A | 2/1986 | Duhl et al. | |
| 4,719,080 A | 1/1988 | Duhl et al. | |
| 4,894,089 A | 1/1990 | Henry | |
| 5,104,614 A | 4/1992 | Ducrocq et al. | |
| 5,270,123 A | 12/1993 | Walston et al. | |
| 5,662,749 A | 9/1997 | Chang | |
| 5,888,316 A | 3/1999 | Erickson | |
| 6,355,117 B1 | 3/2002 | DeLuca et al. | |
| 6,521,175 B1 | 2/2003 | Mourer et al. | |
| 6,706,241 B1 | 3/2004 | Baumann et al. | |
| 6,908,519 B2 | 6/2005 | Raymond et al. | |
| 8,147,749 B2 * | 4/2012 | Reynolds | 420/448 |

(Continued)

FOREIGN PATENT DOCUMENTS

| | | |
|---|---|---|
| EP | 0292320 | 11/1988 |
| EP | 1195446 A1 | 4/2002 |

(Continued)

OTHER PUBLICATIONS

European Search Report for EP Patent Application No. 12180475.1, dated Jul. 23, 2013.
European Office Action for European Patent Application No. 12180475.1, dated May 6, 2014.
US Office Action for U.S. Appl. No. 13/372,585, dated Jan. 27, 2015.

(Continued)

*Primary Examiner* — Jessee Roe
(74) *Attorney, Agent, or Firm* — Bachman & LaPointe, P.C.

(57) ABSTRACT

A composition of matter, comprising in combination, in atomic percent contents: a content of nickel as a largest content; 19.0-21.0 percent cobalt; 9.0-13.0 percent chromium; 1.0-3.0 percent tantalum; 0.9-1.5 percent tungsten; 7.0-9.5 percent aluminum; 0.10-0.25 percent boron; 0.09-0.20 percent carbon; 1.5-2.0 percent molybdenum; 1.1-1.5 percent niobium; 3.0-3.6 percent titanium; and 0.02-0.09 percent zirconium.

26 Claims, 16 Drawing Sheets

(56) References Cited

U.S. PATENT DOCUMENTS

| | | | | |
|---|---|---|---|---|
| 2010/0008790 | A1 | 1/2010 | Reynolds | |
| 2010/0158695 | A1* | 6/2010 | Reynolds | 416/241 R |
| 2010/0303665 | A1 | 12/2010 | Bain et al. | |
| 2010/0303666 | A1 | 12/2010 | Bain et al. | |
| 2010/0329876 | A1 | 12/2010 | Bain et al. | |
| 2010/0329883 | A1 | 12/2010 | Mourer et al. | |
| 2011/0203707 | A1 | 8/2011 | Mourer et al. | |
| 2013/0209266 | A1 | 8/2013 | Reynolds et al. | |

FOREIGN PATENT DOCUMENTS

| | | | |
|---|---|---|---|
| EP | 1201777 | A1 | 5/2002 |
| EP | 1710322 | A1 | 10/2006 |

OTHER PUBLICATIONS

US Office Action for U.S. Appl. No. 13/372,585, dated May 4, 2015.

US Office Action for U.S. Appl. No. 13/372,585, dated May 28, 2015.

David Furrer et al., "Ni-Based Superalloys for Turbine Discs", JOM, Jan. 1999, pp. 14-17, vol. 51, Issue 1, The Minerals, Metals & Materials Society (TMS), Warrendale, Pennsylvania.

Declaration under 37 CFR 1.132 of Darryl Slade Stoltz dated Dec. 2, 2015 in U.S. Appl. No. 13/372,585.

Supplemental Declaration under 37 CFR 1.132 of Darryl Slade Stoltz dated Feb. 29, 2016 in U.S. Appl. No. 13/372,585.

D.R. Chang et al., "Superalloy Powder Processing, Properties and Turbine Disk Applications", Superalloys 1984, 1984, pp. 245-273, General Electric Company, Chincinnati, Ohio.

* cited by examiner

FIG. 3

| Weight % | | Al | B | C | Co | Cr | Hf | Mo | Nb | Ta | Ti | W | Zr | Al + Ta + Cr (Wt.%) |
|---|---|---|---|---|---|---|---|---|---|---|---|---|---|---|
| PJ1 | Aim | 3.25 | 0.04 | 0.03 | 20.20 | 10.48 | | 2.83 | 1.95 | 4.28 | 2.67 | 2.93 | 0.05 | 18.01 |
| | Act | 3.39 | 0.04 | 0.03 | 20.19 | 10.64 | | 3.01 | 1.91 | 4.44 | 2.73 | 3.03 | 0.06 | 18.47 |
| PJ2 | Aim | 3.19 | 0.04 | 0.03 | 20.20 | 9.40 | | 2.83 | 1.95 | 7.19 | 2.67 | 2.93 | 0.05 | 19.78 |
| | Act | 3.38 | 0.04 | 0.02 | 20.34 | 9.55 | | 3.04 | 1.95 | 7.21 | 2.70 | 3.00 | 0.07 | 20.14 |
| PJ3 | Aim | 4.06 | 0.04 | 0.03 | 20.20 | 9.05 | | 2.83 | 1.95 | 4.31 | 2.67 | 2.93 | 0.05 | 17.42 |
| | Act | 4.15 | 0.03 | 0.03 | 20.52 | 9.06 | | 3.04 | 1.94 | 4.37 | 2.70 | 3.05 | 0.07 | 17.58 |
| PJ4 | Aim | 3.97 | 0.04 | 0.03 | 20.20 | 7.99 | | 2.83 | 1.95 | 7.24 | 2.67 | 2.93 | 0.05 | 19.20 |
| | Act | 4.11 | 0.04 | 0.03 | 20.54 | 8.14 | | 2.98 | 1.90 | 7.28 | 2.62 | 2.94 | 0.06 | 19.53 |
| PJ5 | Aim | 3.62 | 0.04 | 0.03 | 20.20 | 9.22 | | 2.83 | 1.95 | 5.77 | 2.67 | 2.93 | 0.05 | 18.61 |
| | Act | 3.76 | 0.04 | 0.03 | 20.49 | 9.24 | | 3.03 | 1.94 | 5.78 | 2.71 | 2.99 | 0.06 | 18.78 |
| PJ6 | Aim | 3.44 | 0.04 | 0.03 | 20.20 | 9.85 | | 2.83 | 1.95 | 5.03 | 2.67 | 2.93 | 0.05 | 18.32 |
| | Act | 3.54 | 0.03 | 0.03 | 20.20 | 9.78 | | 3.00 | 1.90 | 5.04 | 2.64 | 2.94 | 0.06 | 18.36 |
| PJ7 | Aim | 3.40 | 0.04 | 0.03 | 20.20 | 9.31 | | 2.83 | 1.95 | 6.48 | 2.67 | 2.93 | 0.05 | 19.19 |
| | Act | 3.52 | 0.04 | 0.03 | 20.19 | 9.22 | | 2.94 | 1.95 | 6.35 | 2.66 | 2.93 | 0.06 | 19.09 |
| PJ8 | Aim | 3.84 | 0.04 | 0.03 | 20.20 | 9.14 | | 2.83 | 1.95 | 5.05 | 2.67 | 2.93 | 0.05 | 18.03 |
| | Act | 3.92 | 0.03 | 0.03 | 20.39 | 9.26 | | 2.98 | 1.91 | 5.11 | 2.65 | 3.01 | 0.07 | 18.29 |
| PJ9 | Aim | 3.80 | 0.04 | 0.03 | 20.20 | 8.60 | | 2.83 | 1.95 | 6.51 | 2.67 | 2.93 | 0.05 | 18.91 |
| | Act | 3.94 | 0.04 | 0.02 | 20.45 | 8.66 | | 2.97 | 1.93 | 6.51 | 2.64 | 2.96 | 0.07 | 19.11 |
| NWC | Aim | 3.14 | 0.03 | 0.03 | 19.60 | 10.90 | 0.40 | 2.79 | 1.55 | 7.28 | 2.17 | 2.62 | 0.05 | 21.32 |
| | Act | 3.19 | 0.05 | 0.05 | 19.16 | 10.31 | 0.44 | 2.93 | 1.62 | 7.20 | 2.25 | 2.68 | 0.06 | 20.70 |
| NF3 | Aim | 3.60 | 0.03 | 0.03 | 18.00 | 10.50 | | 2.90 | 2.00 | 2.50 | 3.60 | 3.00 | 0.05 | 16.60 |
| | Act | 3.59 | 0.04 | 0.04 | 17.62 | 10.70 | | 3.08 | 2.02 | 2.73 | 3.71 | 3.09 | 0.09 | 17.02 |
| ME16 | Aim | 3.40 | 0.03 | 0.05 | 20.60 | 13.00 | | 3.80 | 0.90 | 2.40 | 3.70 | 2.10 | 0.05 | 18.80 |
| | Act | 3.44 | 0.03 | 0.05 | 19.85 | 12.88 | | 4.05 | 0.81 | 2.30 | 3.89 | 2.22 | 0.05 | 18.62 |

FIG. 4

| Atomic % | | Al | B | C | Co | Cr | Hf | Mo | Nb | Ta | Ti | W | Zr | Al + Ta + Cr (At.%) |
|---|---|---|---|---|---|---|---|---|---|---|---|---|---|---|
| PJ1 | Aim | 7.12 | 0.21 | 0.15 | 20.27 | 11.92 | | 1.74 | 1.24 | 1.40 | 3.30 | 0.94 | 0.03 | 20.44 |
| | Act | 7.43 | 0.22 | 0.15 | 20.25 | 12.10 | | 1.85 | 1.22 | 1.45 | 3.37 | 0.97 | 0.04 | 20.97 |
| PJ2 | Aim | 7.15 | 0.21 | 0.15 | 20.72 | 10.93 | | 1.78 | 1.27 | 2.40 | 3.37 | 0.96 | 0.03 | 20.48 |
| | Act | 7.57 | 0.22 | 0.10 | 20.85 | 11.09 | | 1.91 | 1.27 | 2.41 | 3.41 | 0.99 | 0.04 | 21.07 |
| PJ3 | Aim | 8.83 | 0.21 | 0.15 | 20.12 | 10.22 | | 1.73 | 1.23 | 1.40 | 3.27 | 0.94 | 0.03 | 20.44 |
| | Act | 9.03 | 0.16 | 0.15 | 20.45 | 10.23 | | 1.86 | 1.23 | 1.42 | 3.31 | 0.97 | 0.05 | 20.68 |
| PJ4 | Aim | 8.83 | 0.21 | 0.15 | 20.57 | 9.22 | | 1.77 | 1.26 | 2.40 | 3.35 | 0.96 | 0.03 | 20.46 |
| | Act | 9.13 | 0.19 | 0.15 | 20.89 | 9.38 | | 1.86 | 1.23 | 2.41 | 3.28 | 0.96 | 0.04 | 20.92 |
| PJ5 | Aim | 7.99 | 0.21 | 0.15 | 20.42 | 10.56 | | 1.76 | 1.25 | 1.90 | 3.32 | 0.95 | 0.03 | 20.46 |
| | Act | 8.29 | 0.19 | 0.15 | 20.68 | 10.57 | | 1.88 | 1.24 | 1.90 | 3.37 | 0.97 | 0.04 | 20.76 |
| PJ6 | Aim | 7.57 | 0.21 | 0.15 | 20.34 | 11.24 | | 1.75 | 1.25 | 1.65 | 3.31 | 0.95 | 0.03 | 20.46 |
| | Act | 7.78 | 0.16 | 0.15 | 20.33 | 11.15 | | 1.85 | 1.21 | 1.65 | 3.27 | 0.95 | 0.04 | 20.59 |
| PJ7 | Aim | 7.56 | 0.21 | 0.15 | 20.57 | 10.75 | | 1.77 | 1.26 | 2.15 | 3.35 | 0.96 | 0.03 | 20.46 |
| | Act | 7.81 | 0.22 | 0.15 | 20.51 | 10.62 | | 1.83 | 1.26 | 2.10 | 3.33 | 0.95 | 0.04 | 20.53 |
| PJ8 | Aim | 8.42 | 0.21 | 0.15 | 20.27 | 10.39 | | 1.74 | 1.24 | 1.65 | 3.30 | 0.94 | 0.03 | 20.46 |
| | Act | 8.59 | 0.16 | 0.15 | 20.46 | 10.53 | | 1.84 | 1.22 | 1.67 | 3.27 | 0.97 | 0.05 | 20.79 |
| PJ9 | Aim | 8.42 | 0.21 | 0.15 | 20.50 | 9.89 | | 1.76 | 1.26 | 2.15 | 3.34 | 0.95 | 0.03 | 20.46 |
| | Act | 8.72 | 0.22 | 0.10 | 20.73 | 9.95 | | 1.85 | 1.24 | 2.15 | 3.30 | 0.96 | 0.05 | 20.83 |
| NWC | Aim | 7.04 | 0.17 | 0.15 | 20.12 | 11.74 | 0.14 | 1.76 | 1.01 | 2.43 | 2.74 | 0.86 | 0.03 | 26.06 |
| | Act | 7.14 | 0.30 | 0.24 | 19.62 | 11.97 | 0.15 | 1.84 | 1.05 | 2.40 | 2.84 | 0.88 | 0.04 | 21.50 |
| NF3 | Aim | 7.76 | 0.16 | 0.15 | 17.76 | 11.74 | | 1.76 | 1.25 | 0.80 | 4.37 | 0.95 | 0.03 | 20.30 |
| | Act | 7.74 | 0.22 | 0.21 | 17.40 | 11.98 | | 1.87 | 1.27 | 0.88 | 4.51 | 0.98 | 0.06 | 20.60 |
| ME16 | Aim | 7.26 | 0.16 | 0.24 | 20.14 | 14.40 | | 2.28 | 0.56 | 0.76 | 4.45 | 0.66 | 0.03 | 22.43 |
| | Act | 7.34 | 0.18 | 0.24 | 19.40 | 14.27 | | 2.43 | 0.50 | 0.73 | 4.68 | 0.70 | 0.03 | 22.35 |

FIG. 5

| Alloy | 1350F (732C) Yield Strength | | 1350F (732C) Tensile Strength | | 1500F (816C) Yield Strength | | 1500F (816C) Tensile Strength | | 0.2% Creep Life at 1500F / 65 ksi (816C / 448 MPa) (hours) | Rupture Life at 1500F / 65 ksi (816C / 448 MPa) (hours) | 0.2% Creep Life at 1350F / 110 ksi (732C / 758 MPa) (hours) |
|---|---|---|---|---|---|---|---|---|---|---|---|
| | ksi | MPa | ksi | MPa | ksi | MPa | ksi | MPa | | | |
| PJ1 | 127 | 876 | 167 | 1151 | 121 | 834 | 134 | 924 | 10.5 | 273 | 3.3 |
| PJ2 | 132 | 910 | 173 | 1193 | 127 | 876 | 138 | 951 | 23.6 | 368 | 12.5 |
| PJ3 | 130 | 896 | 165 | 1138 | 125 | 862 | 137 | 945 | 19.6 | 198 | 5.7 |
| PJ4 | 134 | 924 | 171 | 1179 | 130 | 896 | 141 | 972 | 18 | 227 | 7.9 |
| PJ5 | 133 | 917 | 171 | 1179 | 129 | 889 | 139 | 958 | 24.3 | 261 | 32.9 |
| PJ6 | 131 | 903 | 169 | 1165 | 125 | 862 | 136 | 938 | 23.5 | 288 | 84.4 |
| PJ7 | 130 | 896 | 170 | 1172 | 126 | 869 | 137 | 945 | 17.6 | 227 | 15.7 |
| PJ8 | 131 | 903 | 168 | 1158 | 127 | 876 | 138 | 951 | 22.1 | 277 | 9.1 |
| PJ9 | 135 | 931 | 171 | 1179 | 129 | 889 | 141 | 972 | 41.7 | 378 | 19.5 |
| ME16 | | | | | 117 | 807 | | | 6.3 | 100 | |
| NF3 | 134 | 924 | 166 | 1145 | 125 | 862 | 136 | 938 | 15 | 217 | 3.7 |
| NWC | 128 | 883 | 169 | 1165 | 124 | 855 | 134 | 924 | 11.1 | 180 | 9.3 |

SUPERALLOY COMPOSITIONS, ARTICLES, AND METHODS OF MANUFACTURE

U.S. GOVERNMENT RIGHTS

The invention was made with U.S. Government support under Agreement No. N00421-02-3-3111 awarded by the Naval Air Systems Command. The U.S. Government has certain rights in the invention.

BACKGROUND

The disclosure relates to nickel-base superalloys. More particularly, the disclosure relates to such superalloys used in high-temperature gas turbine engine components such as turbine disks and compressor disks.

The combustion, turbine, and exhaust sections of gas turbine engines are subject to extreme heating as are latter portions of the compressor section. This heating imposes substantial material constraints on components of these sections. One area of particular importance involves blade-bearing turbine disks. The disks are subject to extreme mechanical stresses, in addition to the thermal stresses, for significant periods of time during engine operation.

Exotic materials have been developed to address the demands of turbine disk use. U.S. Pat. No. 6,521,175 (the '175 patent) discloses an advanced nickel-base superalloy for powder metallurgical (PM) manufacture of turbine disks. The disclosure of the '175 patent is incorporated by reference herein as if set forth at length. The '175 patent discloses disk alloys optimized for short-time engine cycles, with disk temperatures approaching temperatures of about 1500° F. (816° C.) US20100008790 (the '790 publication) discloses a nickel-base disk alloy having a relatively high concentration of tantalum coexisting with a relatively high concentration of one or more other components Other disk alloys are disclosed in U.S. Pat. No. 5,104,614, U.S. Pat. No. 5,662,749, U.S. Pat. No. 6,908,519, EP1201777, and EP1195446.

Separately, other materials have been proposed to address the demands of turbine blade use. Blades are typically cast and some blades include complex internal features. U.S. Pat. Nos. 3,061,426, 4,209,348, 4,569,824, 4,719,080, 5,270,123, 6,355,117, and 6,706,241 disclose various blade alloys. More recently, US20100008790 has disclosed a high tantalum disk alloy.

SUMMARY

One aspect of the disclosure involves a composition of matter, comprising in combination, in atomic percent contents: a content of nickel as a largest content; 19.0-21.0 percent cobalt; 9.0-13.0 percent chromium; 1.0-3.0 percent tantalum; 0.9-1.5 percent tungsten; 7.0-9.5 percent aluminum; 0.10-0.25 percent boron; 0.09-0.20 percent carbon; 1.5-2.0 percent molybdenum; 1.1-1.5 percent niobium; 3.0-3.6 percent titanium; and 0.02-0.09 percent zirconium.

In additional or alternative embodiments of any of the foregoing embodiments, the contents are, more specifically, one or more of: 20.1-21.0 percent cobalt 9.2-12.5 percent chromium 1.4-2.5 percent tantalum 0.94-1.3 percent tungsten 7.1-9.2 percent aluminum 0.14-0.24 percent boron 0.09-0.20 percent carbon 1.7-2.0 percent molybdenum 1.15-1.30 percent niobium 3.20-3.50 percent titanium; and 0.03-0.07 percent zirconium.

In additional or alternative embodiments of any of the foregoing embodiments, the contents are, more specifically one or more of: 20.3-20.9 percent cobalt 9.4-11.3 percent chromium 1.8-2.5 percent tantalum 0.9-1.0 percent tungsten 7.9-9.2 percent aluminum 0.15-0.23 percent boron 0.09-0.16 percent carbon 1.74-1.95 percent molybdenum 1.20-1.26 percent niobium 3.25-3.45 percent titanium; and 0.03-0.06 percent zirconium.

In additional or alternative embodiments of any of the foregoing embodiments the composition consists essentially of said combination.

In additional or alternative embodiments of any of the foregoing embodiments, the composition comprises no more than 0.50 weight percent hafnium.

In additional or alternative embodiments of any of the foregoing embodiments, the composition of claim 1 comprises no more than 0.05 weight percent hafnium.

In additional or alternative embodiments of any of the foregoing embodiments, said content of nickel is at least 50 weight percent.

In additional or alternative embodiments of any of the foregoing embodiments, said content of nickel is 43-57 weight percent.

In additional or alternative embodiments of any of the foregoing embodiments, said content of nickel of 48-52 weight percent.

In additional or alternative embodiments of any of the foregoing embodiments, a value $(Ta/Cr)^2$ is above 0.022 using atomic percent.

In additional or alternative embodiments of any of the foregoing embodiments, a value (1/(Al*Cr)) is above 0.011 using atomic percent.

In additional or alternative embodiments of any of the foregoing embodiments, a value (Cr*Ta) is above 17.5 using atomic percent.

In additional or alternative embodiments of any of the foregoing embodiments, a value (Cr/Ta) is below 7.21 using atomic percent.

In additional or alternative embodiments of any of the foregoing embodiments, a value ((Al*Ta)/Cr) is above 1.15 using atomic percent.

In additional or alternative embodiments of any of the foregoing embodiments, a value Ta is above 1.45 using atomic percent.

In additional or alternative embodiments of any of the foregoing embodiments, a value Ta is above 1.67 using atomic percent.

In additional or alternative embodiments of any of the foregoing embodiments, a value (Cr/(Al*Ta)) is below 1.0 using atomic percent.

In additional or alternative embodiments of any of the foregoing embodiments, a value (Cr/(Al*Ta)) is below 0.53 using atomic percent.

In additional or alternative embodiments of any of the foregoing embodiments, a value $((Cr/Al)^2)$ is less than 2.15 using atomic percent.

In additional or alternative embodiments of any of the foregoing embodiments, the composition comprises no more than 1.0 weight percent, individually, of every additional constituent, if any.

In additional or alternative embodiments of any of the foregoing embodiments, the composition comprises no more than 1.0 weight percent, in total, of all additional constituents, if any.

In additional or alternative embodiments of any of the foregoing embodiments, the composition is in powder form.

Another aspect of the disclosure involves a process for forming an article comprising: compacting a powder having the composition of any of the foregoing embodiments forging a precursor formed from the compacted powder; and machining the forged precursor.

In additional or alternative embodiments of any of the foregoing embodiments, the process further comprises heat treating the precursor, at least one of before and after the machining, by heating to a temperature of no more than 1232° C. (2250° F.)

In additional or alternative embodiments of any of the foregoing embodiments, the process further comprises heat treating the precursor, at least one of before and after the machining, the heat treating effective to increase a characteristic γ grain size from a first value of about 10 μm or less to a second value of 20-120 μm.

Another aspect of the disclosure involves a gas turbine engine turbine or compressor disk having the composition of any of the foregoing embodiments The details of one or more embodiments are set forth in the accompanying drawings and the description below. Other features, objects, and advantages will be apparent from the description and drawings, and from the claims.

BRIEF DESCRIPTION OF THE DRAWINGS

FIG. 3 is a table of compositions of nine particular exemplary alloys and of prior art alloys (both "aim"/target/nominal and "actual" ("act")/measured) in weight percent.

FIG. 4 is a table of said compositions in atomic percent.

FIG. 5 table of properties of the nine alloys and prior art alloys.

Like reference numbers and designations in the various drawings indicate like elements.

DETAILED DESCRIPTION

Figures 1, 2:
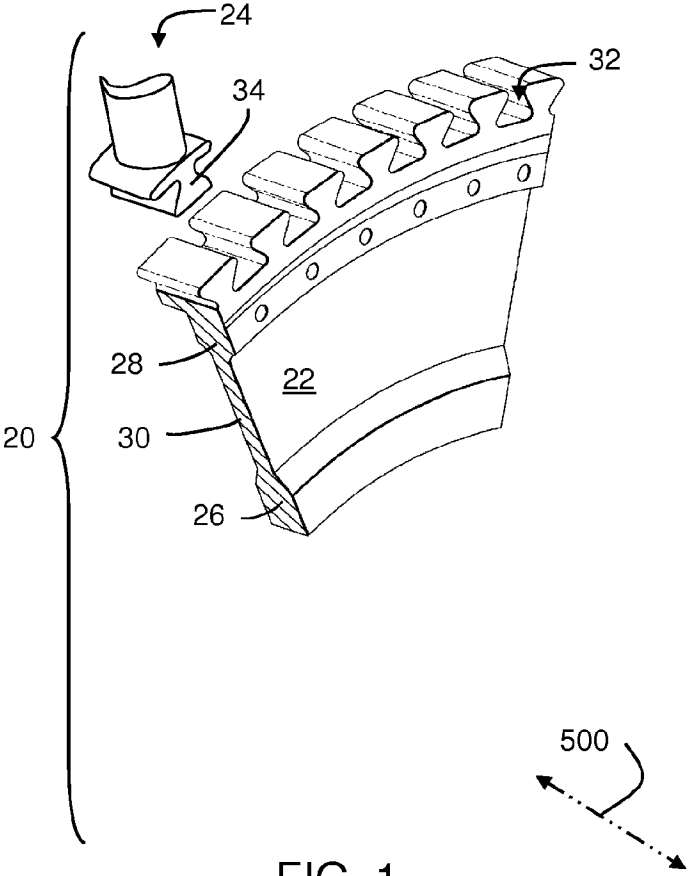
FIG. 1 is an exploded partial view of a gas turbine engine turbine disk assembly.
FIG. 2 is a flowchart of a process for preparing a disk of the assembly of FIG. 1.

FIG. 1 shows a gas turbine engine disk assembly 20 including a disk 22 and a plurality of blades 24. The disk is generally annular, extending from an inboard bore or hub 26 at a central aperture to an outboard rim 28. A relatively thin web 30 is radially between the bore 26 and rim 28. The periphery of the rim 28 has a circumferential array of engagement features 32 (e.g., dovetail slots) for engaging complementary features 34 of the blades 24. In other embodiments, the disk and blades may be a unitary structure (e.g., so-called "integrally bladed" rotors or disks).

The disk 22 is advantageously formed by a powder metallurgical forging process (e.g., as is disclosed in U.S. Pat. No. 6,521,175). FIG. 2 shows an exemplary process. The elemental components of the alloy are mixed (e.g., as individual components of refined purity or alloys thereof). The mixture is melted sufficiently to eliminate component segregation. The melted mixture is atomized to form droplets of molten metal. The atomized droplets are cooled to solidify into powder particles. The powder may be screened to restrict the ranges of powder particle sizes allowed. The powder is put into a container. The container of powder is consolidated in a multi-step process involving compression and heating. The resulting consolidated powder then has essentially the full density of the alloy without the chemical segregation typical of larger castings. A blank of the consolidated powder may be forged at appropriate temperatures and deformation constraints to provide a forging with the basic disk profile. The forging is then heat treated in a multi-step process involving high temperature heating followed by a rapid cooling process or quench. Preferably, the heat treatment increases the characteristic gamma (γ) grain size from an exemplary 10 μm or less to an exemplary 20-120 μm (with 30-60 μm being preferred). The quench for the heat treatment may also form strengthening precipitates (e.g., gamma prime (γ') and eta (η) phases discussed in further detail below) of a desired distribution of sizes and desired volume percentages. Subsequent heat treatments are used to modify these distributions to produce the requisite mechanical properties of the manufactured forging. The increased grain size is associated with good high-temperature creep-resistance and decreased rate of crack growth during the service of the manufactured forging. The heat treated forging is then subject to machining of the final profile and the slots.

Whereas typical modern disk alloy compositions contain 0-3 weight percent tantalum (Ta), the present alloys have a higher level. More specifically, levels above 3% Ta (e.g., 4.2-6.1 wt %) combined with relatively high levels of other γ' formers (namely, one or a combination of aluminum (Al), titanium (Ti), niobium (Nb), tungsten (W), and hafnium (Hf)) and relatively high levels of cobalt (Co) are believed unique. The Ta serves as a solid solution strengthening additive to the γ' and to the γ. The presence of the relatively large Ta atoms reduces diffusion principally in the γ' phase but also in the γ. This may reduce high-temperature creep. At higher levels of Ta, formation of η phase can occur. These exemplary levels of Ta are less than those of the US '790 example.

It is also worth comparing the inventive alloys to the modern blade alloys. Relatively high Ta contents are common to modern blade alloys. There may be several compositional differences between the inventive alloys and modern blade alloys. The blade alloys are typically produced by casting techniques as their high-temperature capability is enhanced by the ability to form very large polycrystalline and/or single grains (also known as single crystals). Use of such blade alloys in powder metallurgical applications is compromised by the formation of very large grain size and their requirements for high-temperature heat treatment. The resulting cooling rate would cause significant quench cracking and tearing (particularly for larger parts). Among other differences, those blade alloys have a lower cobalt (Co) concentration than the exemplary inventive alloys. Broadly, relative to high-Ta modern blade alloys, the exemplary inventive alloys have been customized for utilization in disk manufacture through the adjustment of several other elements, including one or more of Al, Co, Cr, Hf, Mo, Nb, Ti, and W. Nevertheless, possible use of the inventive alloys for blades, vanes, and other non-disk components can't be excluded.

It is noted that wherever both metric and English units are given the metric is a conversion from the English (e.g., an English measurement) and should not be regarded as indicating a false degree of precision.

EXAMPLES

FIGS. 3&4 below show nominal target and measured test compositions for a plurality of test alloys (named PJ1-PJ9). The tables also show nominal compositions of the prior art alloys NF3, ME16, and NWC (discussed, e.g., in U.S. Pat. No. 6,521,175, EP1195446, and US20100008790 respectively).

One difference over ME16 and NF3 is the Ta content which helps with high temperature strength and creep/rupture. Differences over ME16 and NF3 and NWC are lower Cr for high temp strength/creep/rupture, higher Nb for creep/rupture, and higher Ti and Al to swap for lower density.

1500° F. yield strength (YS) and ultimate tensile strength (UTS) tests (that are density corrected for each alloy) illustrate trends with certain special elemental characteristics as found with statistical regressions: a negative trend for YS with (Cr/(Ta*Al)) content; a negative trend for UTS with $(Cr/Al)^2$ content; and a negative trend for UTS with $(1/Ta)^2$ content.

Figure 6:
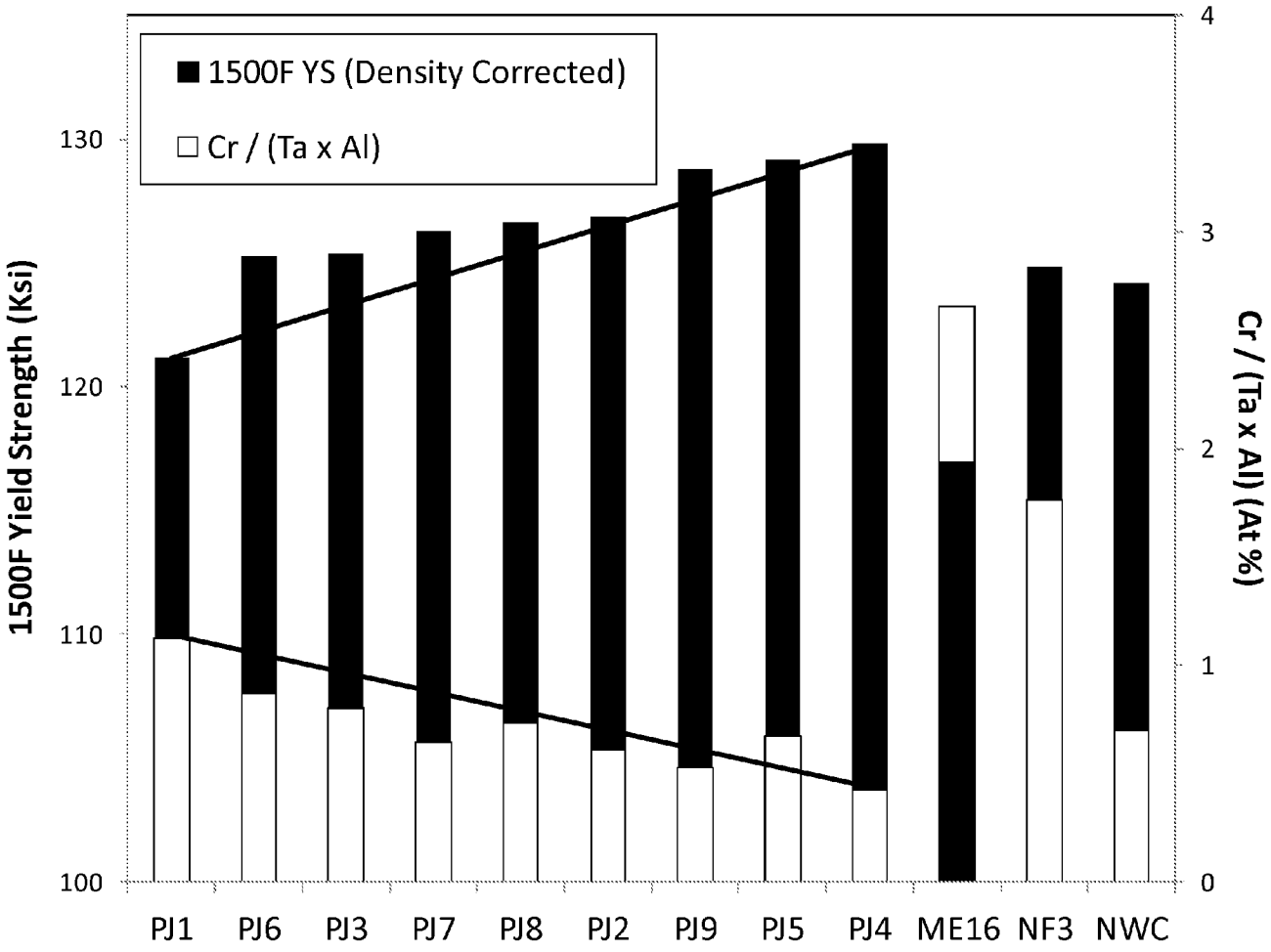
FIG. 6 is a dual bar graph of: 1500° F. (816° C.) yield strength (YS); and ratio of chromium to the product of tantalum and aluminum contents using atomic percent.

FIG. 6 shows, for the exemplary family of alloys, that the value (Cr/(Al*Ta)) below 0.87 using atomic percent (in conjunction with higher Ta than ME16 and NF3 (e.g., ≥1.0 or ≥1.3 or ≥1.4 or ≥1.5 or ≥1.6 or ≥1.8) and lower Cr than ME16, NF3, and NWC (e.g., ≥11.7 or ≥11.4 or ≥11.3 or ≥1.11 or ≥10.70)) achieves 1500° F. YS superior to those prior art alloys.

Figure 7:
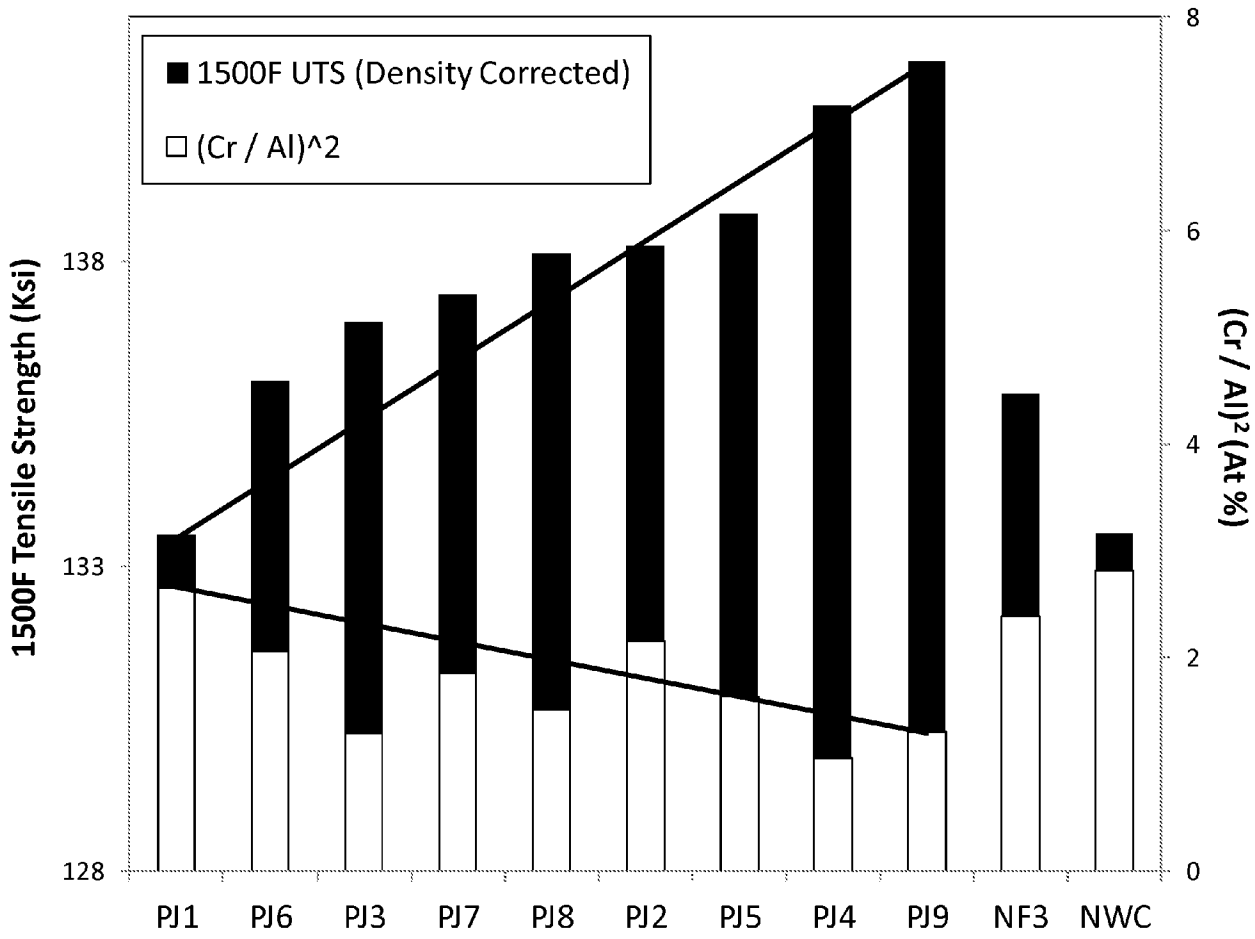
FIG. 7 is a dual bar graph of: 1500° F. (816° C.) ultimate tensile strength (UTS); and the square of the ratio of chromium to aluminum contents using atomic percent.

FIG. 7 shows, for the exemplary family of alloys, that the value $((Cr/Al)^2)$ less than 2.15 using atomic percent (in conjunction with higher Ta than ME16 and NF3 and lower Cr than ME16, NF3, and NWC) achieves 1500° F. UTS superior to those prior art alloys.

Figure 8:
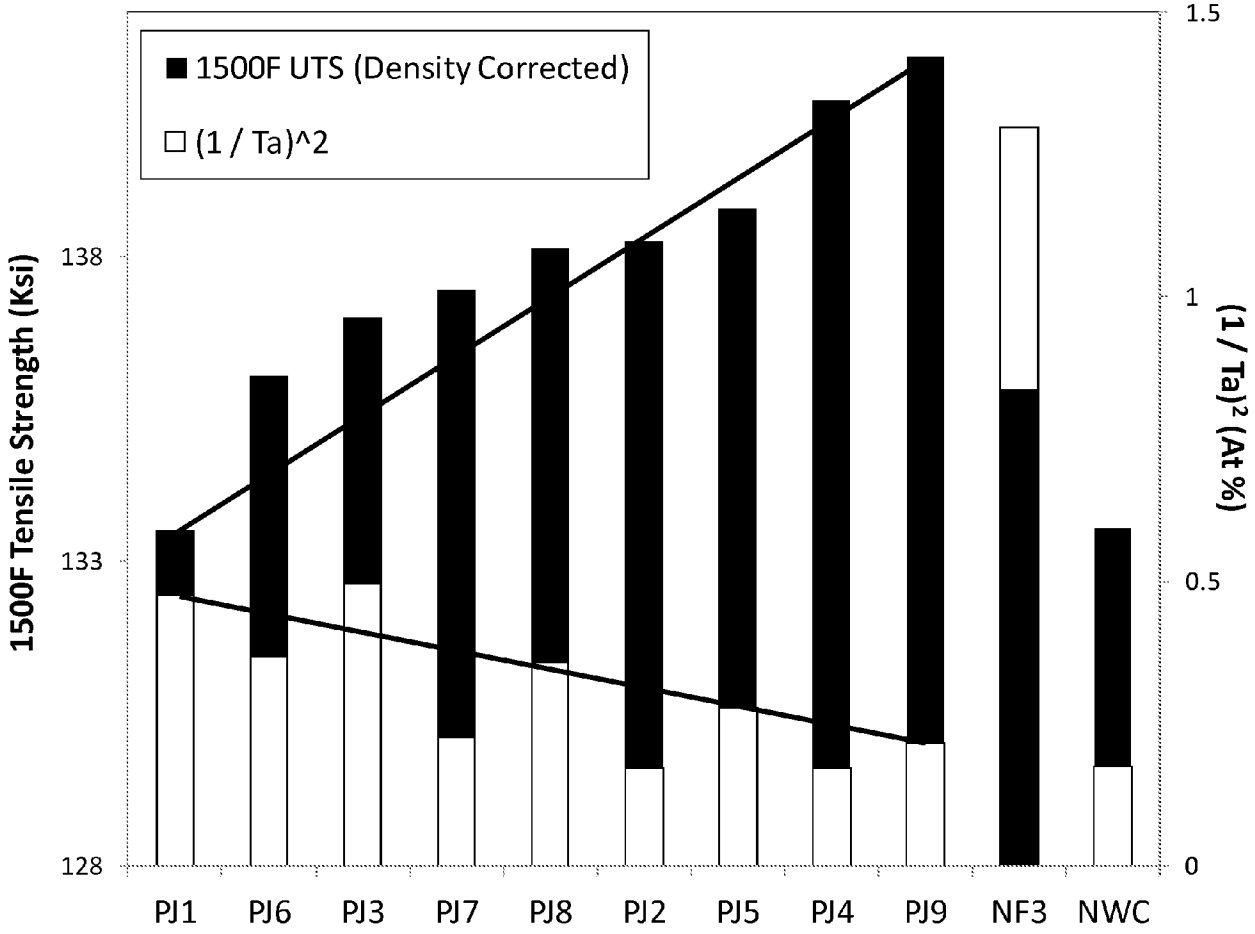
FIG. 8 is a dual bar graph of: 1500° F. (816° C.) ultimate tensile strength; and square of the inverse of a tantalum content using atomic percent.

FIG. 8 shows, for the exemplary family of alloys, that the value $((1/Ta)^2)$ below 0.5 using atomic percent (in conjunction with higher Ta than ME16 and NF3 and lower Cr than ME16, NF3, and NWC) achieves 1500° F. UTS superior to those prior art alloys.

Figure 9:
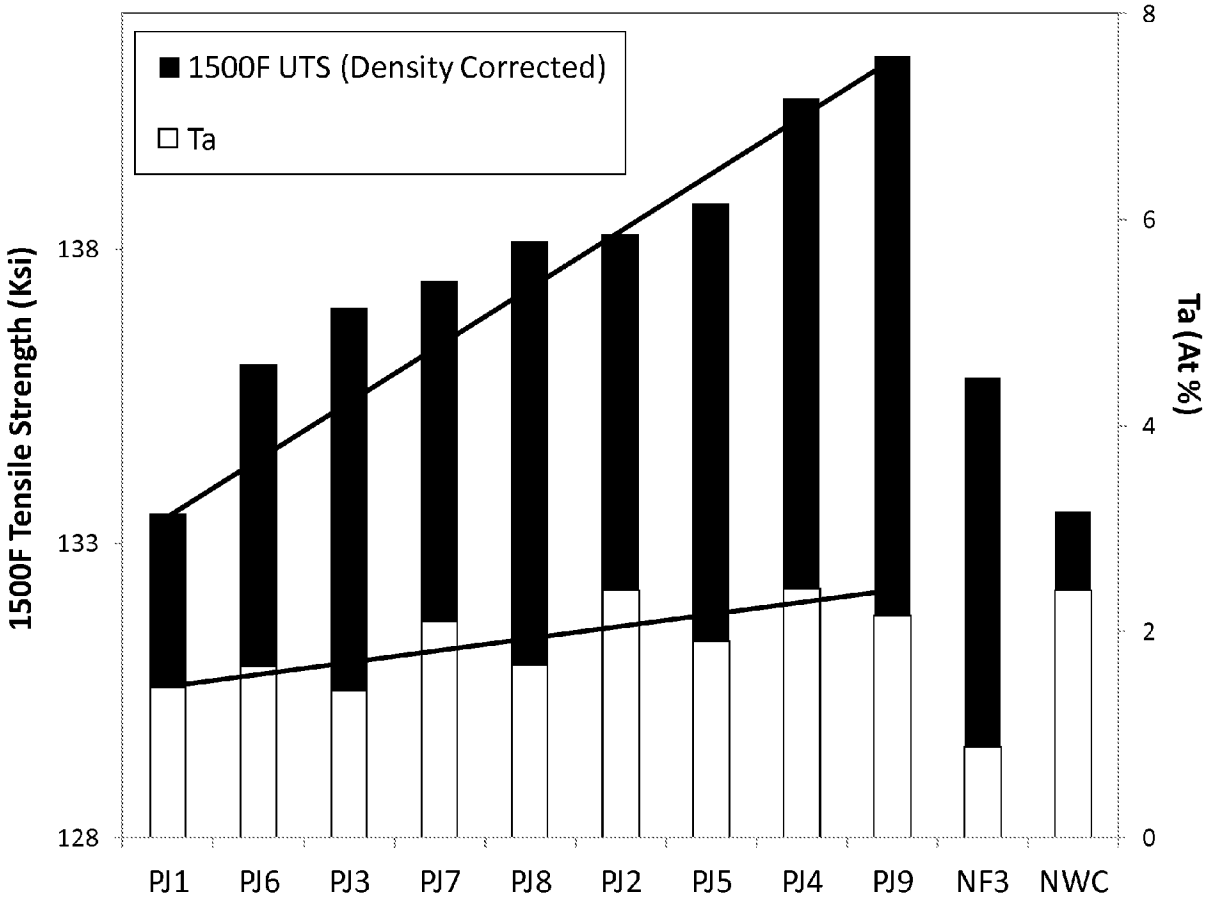
FIG. 9 is a dual bar graph of: 1500° F. (816° C.) UTS; and tantalum composition using atomic percent.

FIG. 9 shows, for the exemplary family of alloys, that the value Ta above 1.45 using atomic percent (in conjunction with higher Ta than ME16 and NF3 and lower Cr than ME16, NF3, and NWC) achieves 1500° F. UTS superior to those prior art alloys.

1350° F. yield strength (YS) (ME16 value estimated via regression to compensate for different cooling rate of sample; 1350° F. YS is particularly sensitive to cooling) and ultimate tensile strength (UTS) tests (that are density corrected for each alloy) illustrate trends with certain special elemental characteristics as found with statistical regressions: a negative trend for YS with (Cr/(Ta*Al)) content; and a negative trend for UTS with $(1/Ta)^2$ content.

Figure 10:
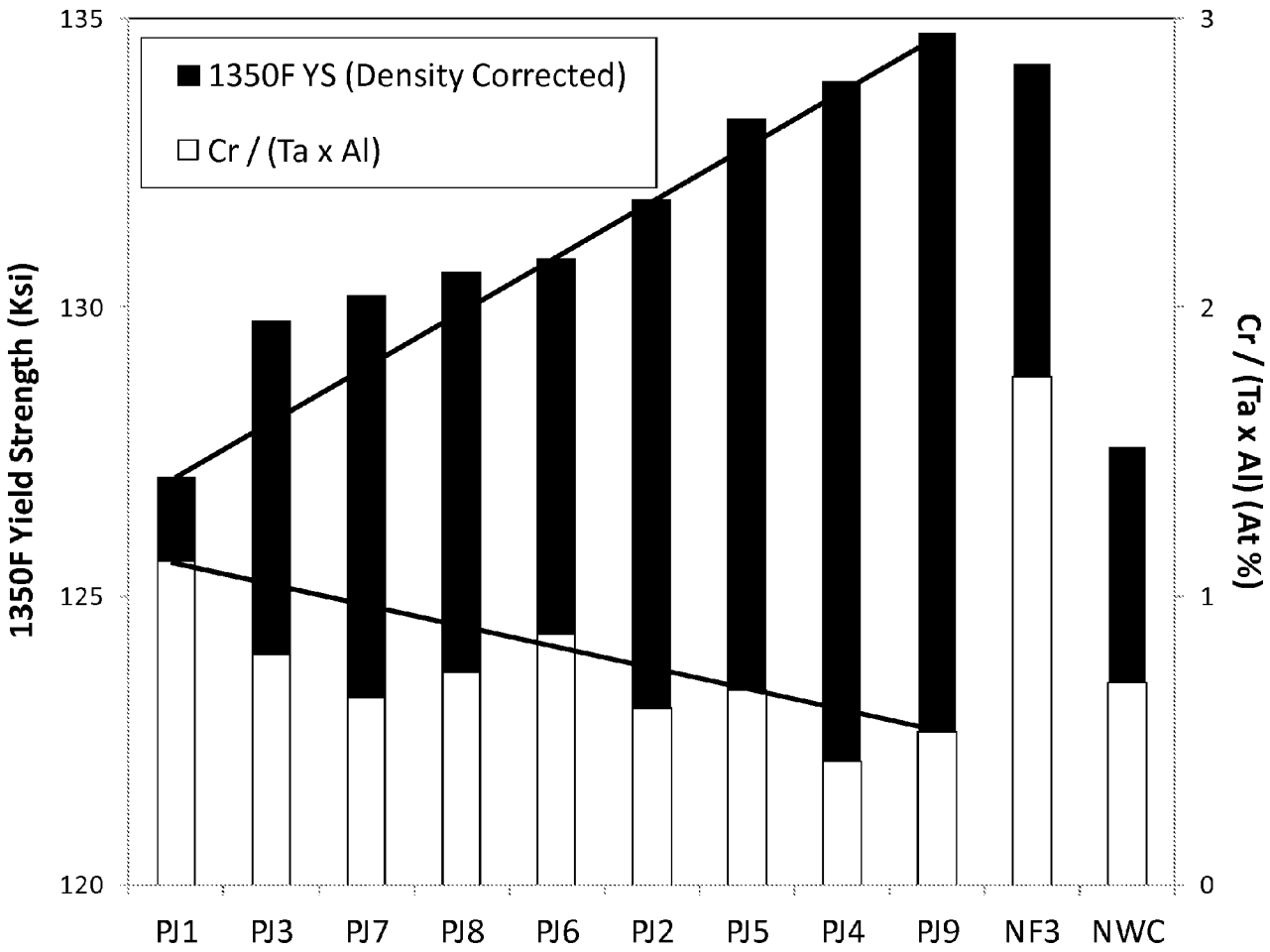
FIG. 10 is a dual bar graph of: 1350° F. (732° C.) yield strength; and ratio of chromium to the product of tantalum and aluminum contents using atomic percent.

FIG. 10 shows, for the exemplary family of alloys, that the value Cr/(Al*Ta) below 0.53 using atomic percent (in conjunction with higher Ta than ME16 and NF3 and lower Cr than ME16, NF3, and NWC) achieves 1350° F. YS superior or equivalent to those prior art alloys. With this ratio limit set as at or below 1.0, ME16 and NF3 are excluded and NWC has much worse YS than the lower chromium variants PJ2-PJ9 (e.g., ≤11.2 or ≤10.8 atomic percent Cr). An alternative value for this value also easily excluding ME16 and NF3 is at or below 0.9 or at or below 0.7.

Figure 11:
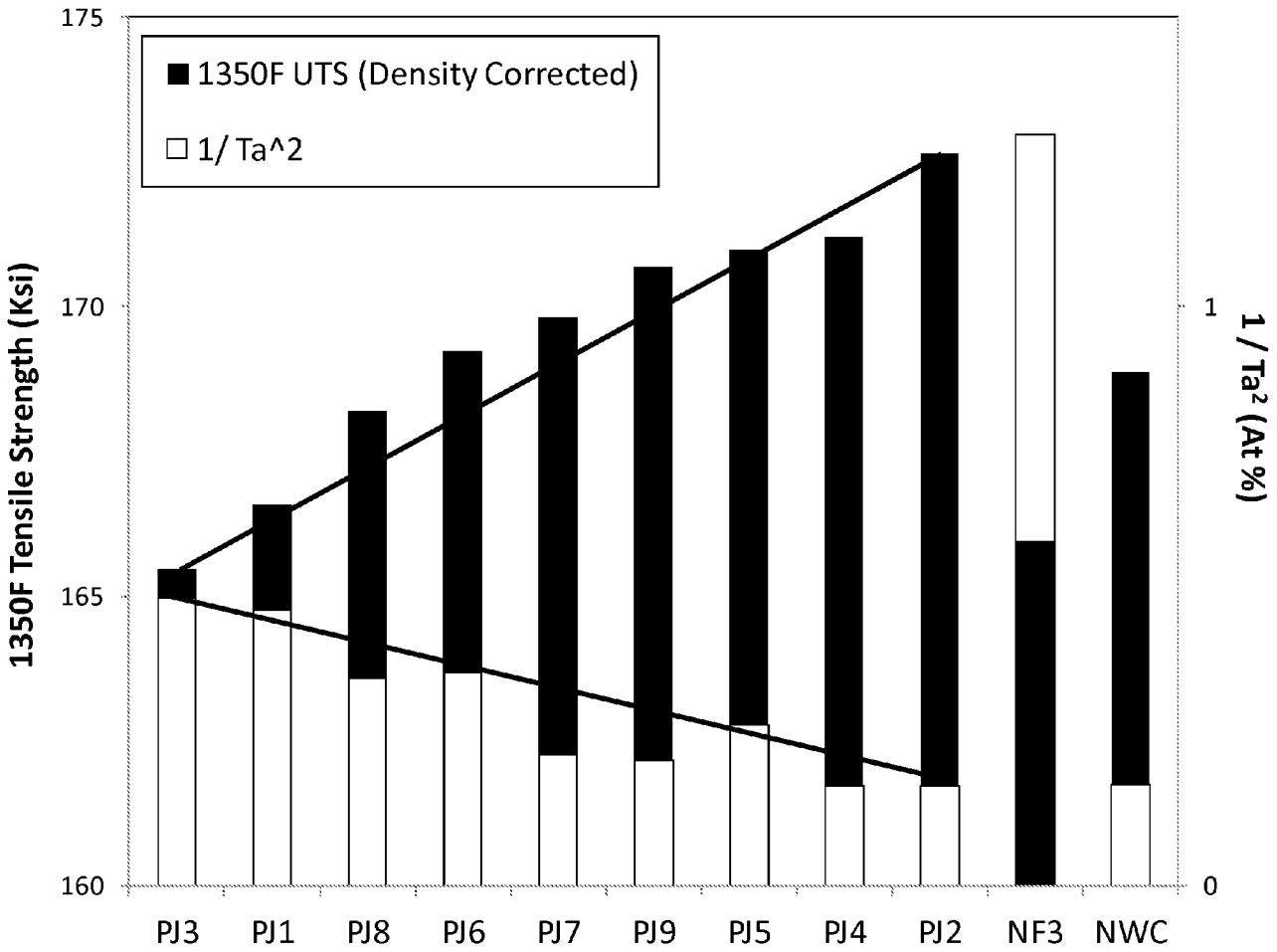
FIG. 11 is a bar graph of: 1350° F. (732° C.) ultimate tensile strength; and square of the inverse of a tantalum content using atomic percent.

FIG. 11 shows, for the exemplary family of alloys, that the value $(1/Ta)^2$ below 0.35 using atomic percent (in conjunction with higher Ta than ME16 and NF3 and lower Cr than ME16, NF3, and NWC) achieves 1350° F. UTS superior to those prior art alloys.

Figure 12:
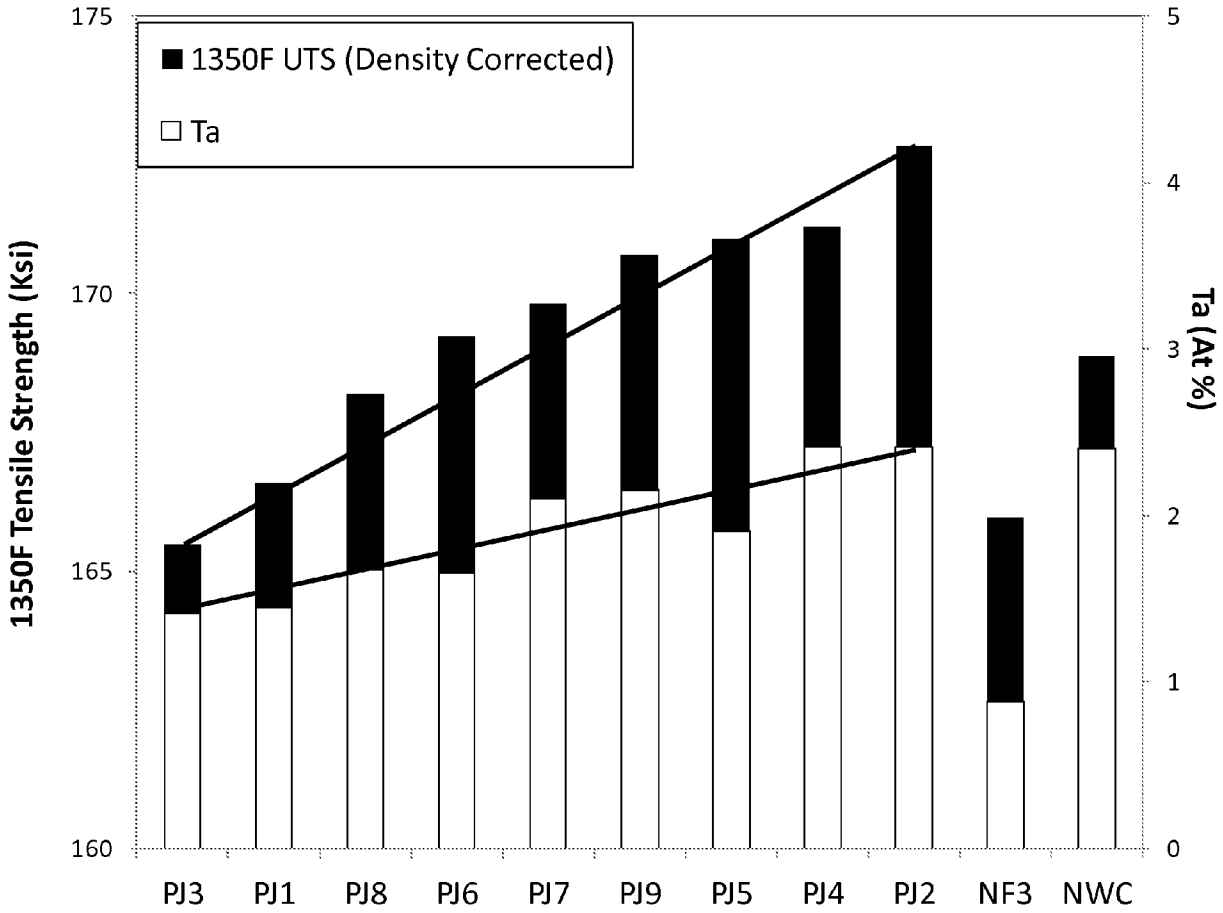
FIG. 12 is a dual bar graph of: 1350° F. (732° C.) ultimate tensile strength and tantalum content in atomic percent.

FIG. 12 shows, for the exemplary family of alloys, that the value Ta above 1.67 using atomic percent (in conjunction with higher Ta than ME16 and NF3 and lower Cr than ME16, NF3, and NWC) achieves 1350° F. UTS superior to those prior art alloys.

1500° F. creep (of 0.2%) tests illustrate trends with certain special elemental characteristics as found with statistical regressions: a positive trend with the (Al/(Ta*Cr)) content; and a negative trend with (Cr/Ta) content. PJ4 and PJ7 are outliers for most of the time dependant properties (creep and rupture).

Figure 13:
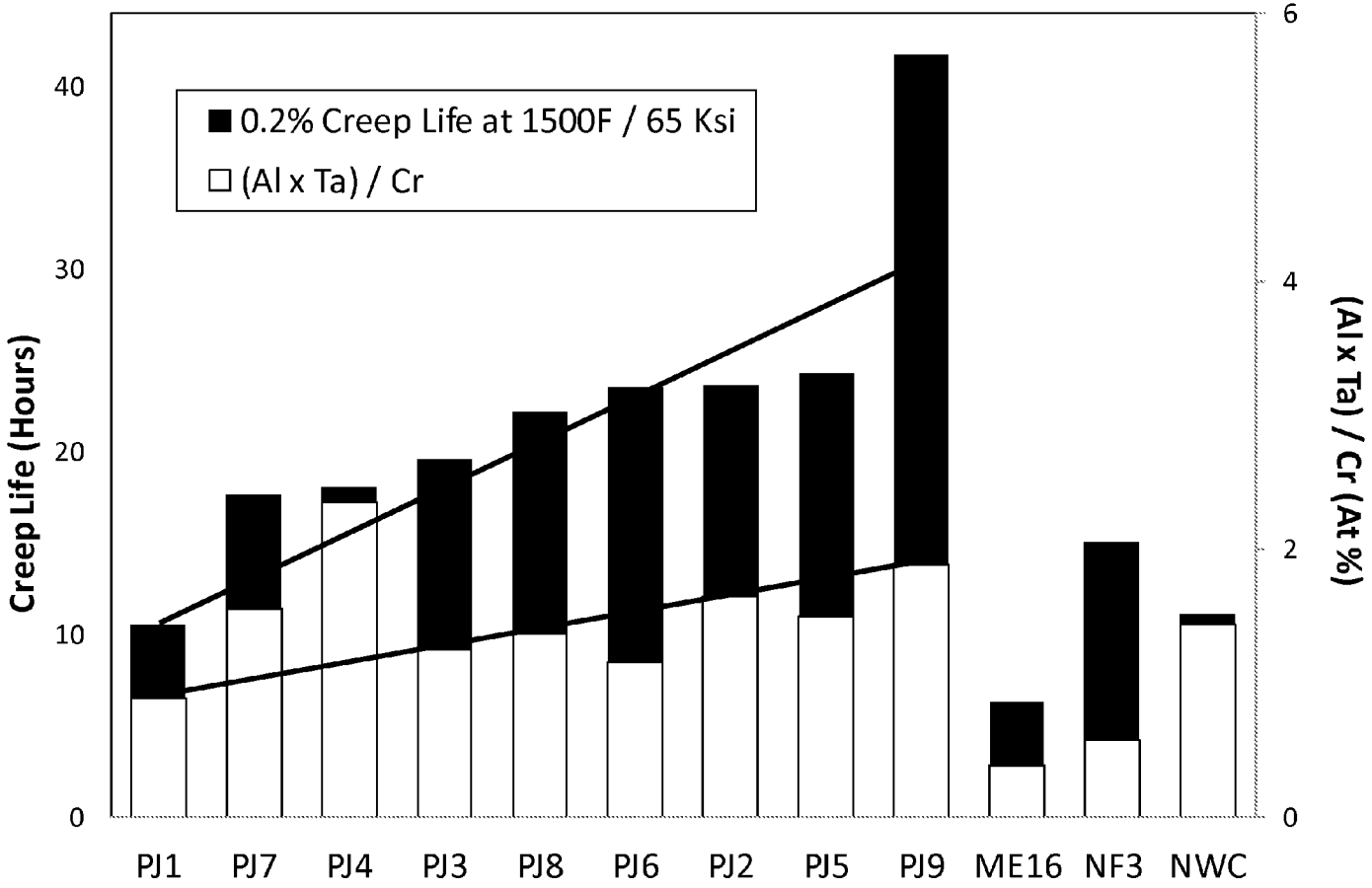
FIG. 13 is a dual bar graph of: 1500° F. (816° C.) creep life and; ratio of the product of aluminum and tantalum contents divided by chromium content in atomic percent.

FIG. 13 shows, for the exemplary family of alloys, that the value ((Al*Ta)/Cr) above 1.15 using atomic percent (in conjunction with higher Ta than ME16 and NF3, higher Nb than ME16 and NWC (e.g., ≥1.15 or ≥1.20 or 1.20-1.30 or 1.20-1.26), and lower Cr than ME16, NF3, and NWC) achieves 1500° F. creep life superior to those prior art alloys.

Figure 14:
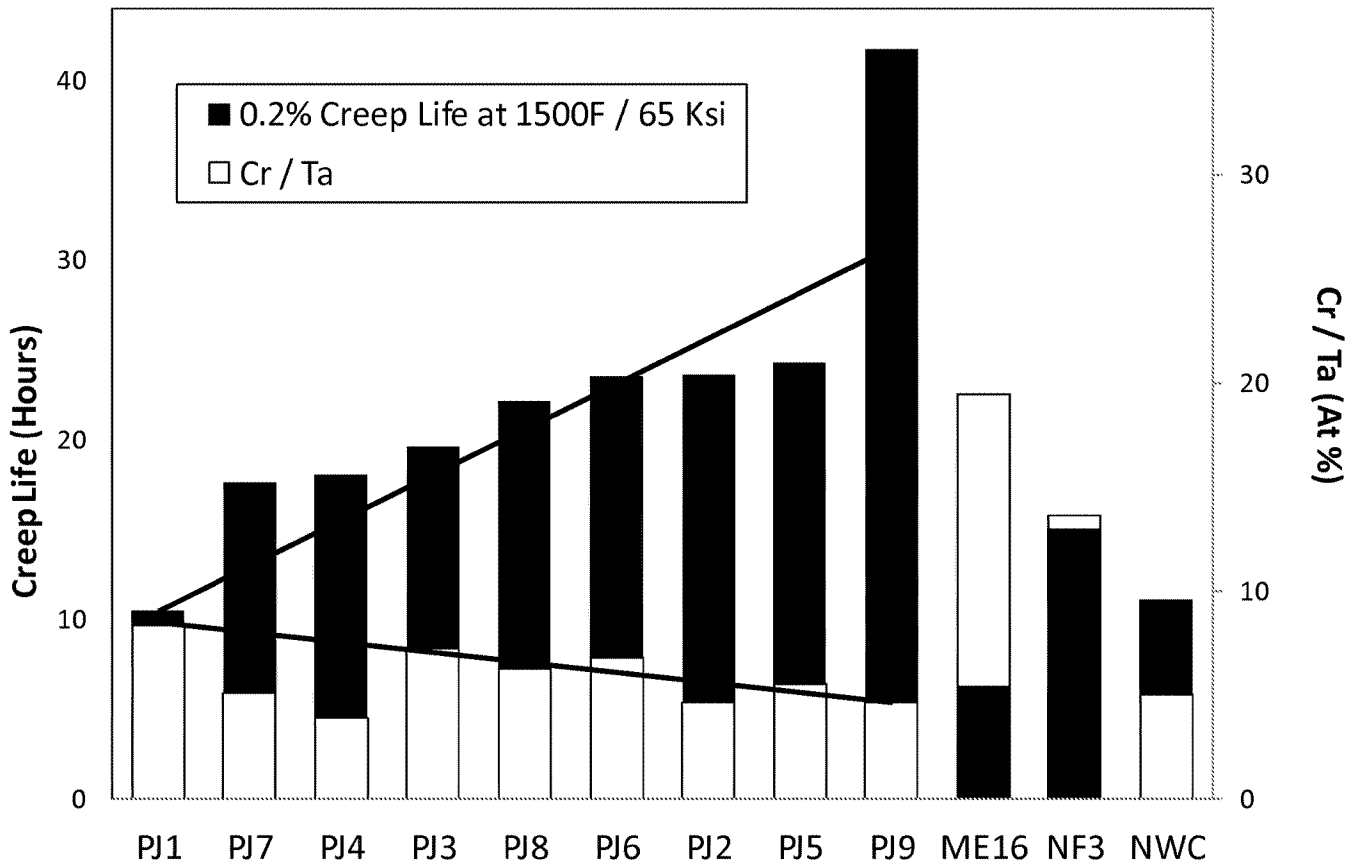
FIG. 14 is a dual bar graph of: 1500° F. (816° C.) creep life; and ratio of chromium to tantalum contents using atomic percent.

FIG. 14 shows, for the exemplary family of alloys, that the value (Cr/Ta) below 7.21 using atomic percent (in conjunction with higher Ta than ME16 and NF3, higher Nb than ME16 and NWC, and lower Cr than ME16, NF3, and NWC) achieves 1500° F. creep life superior to those prior art alloys.

1500° F. rupture tests illustrate trends with certain special elemental characteristics as found with statistical regressions: a positive trend with the (Cr*Ta) content; and a positive trend with the (1/(Al*Cr)) content. The alloys PJ4 and PJ7 are outliers for most of the time dependant properties (creep and rupture).

Figure 15:
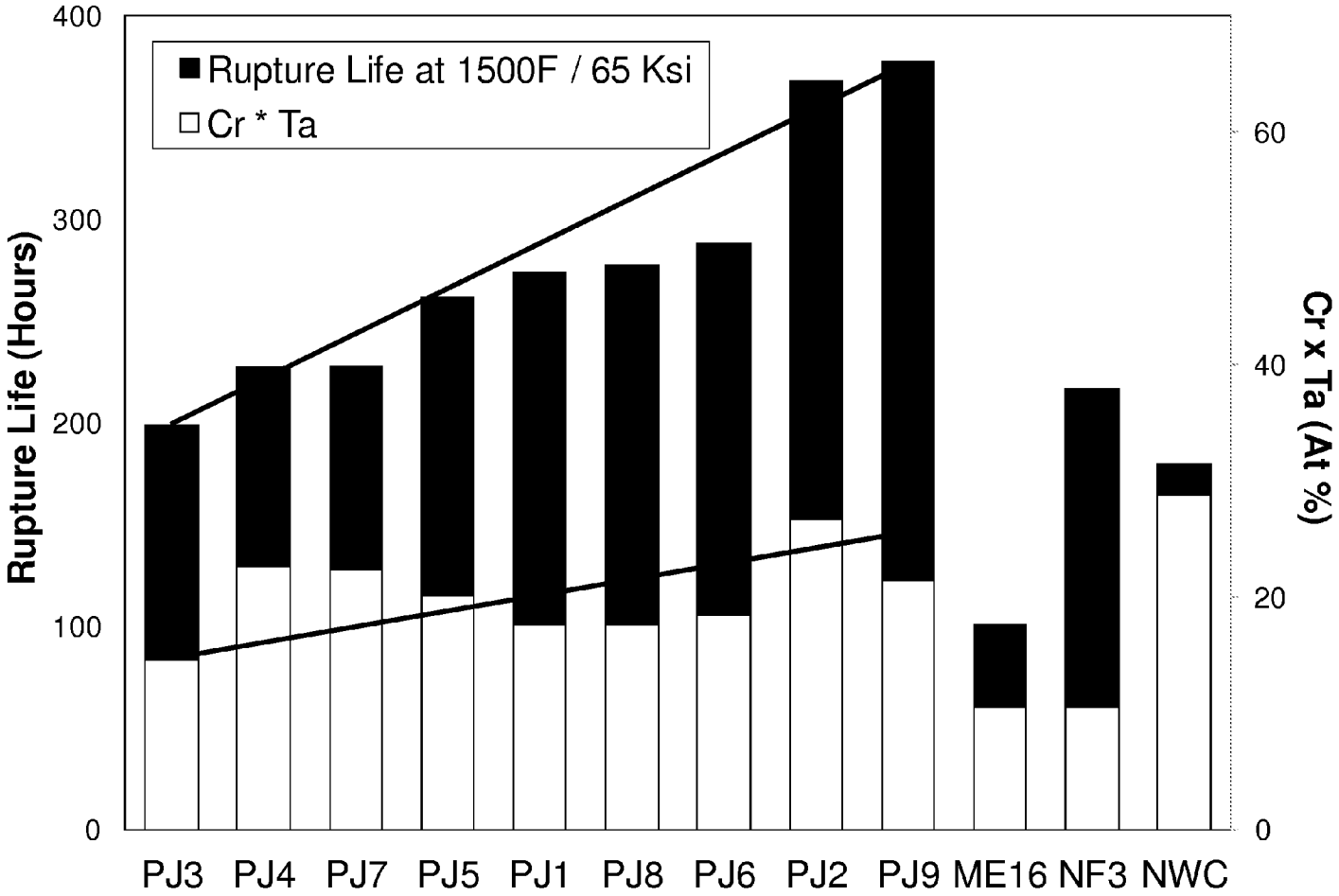
FIG. 15 is a dual bar graph of: 1500° F. (816° C.) rupture life; and product of chromium and tantalum contents in atomic percent.

FIG. 15 shows, for the exemplary family of alloys, that the value (Cr*Ta) above 17.5 using atomic percent (in conjunction with higher Ta than ME16 and NF3, higher Nb than ME16 and NWC, and lower Cr than ME16, NF3, and NWC) achieves 1500° F. rupture life superior to those prior art alloys.

Figure 16:
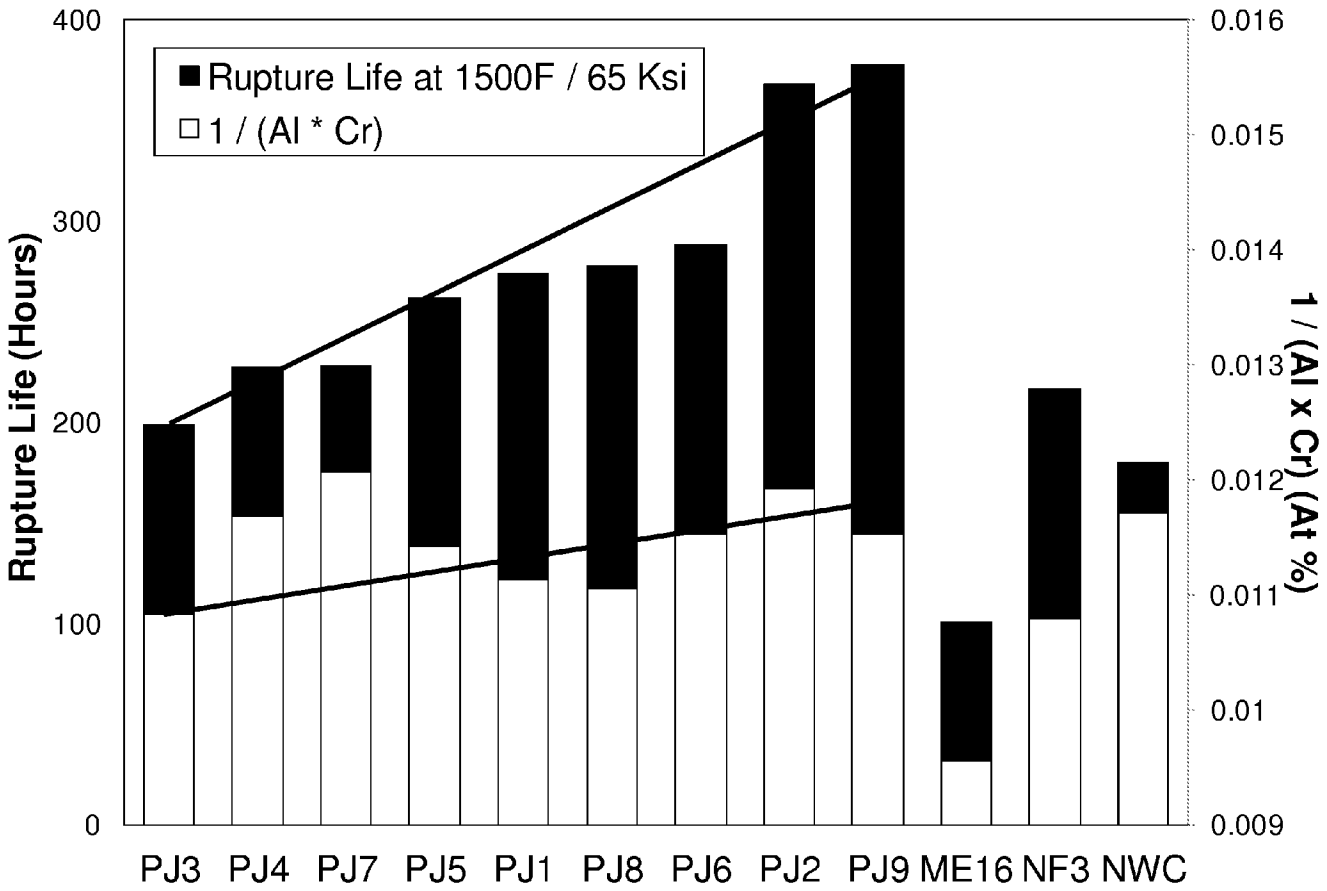
FIG. 16 is a dual bar graph of: the 1500° F. (816° C.) rupture life; and inverse of the product of aluminum and chromium contents using atomic percent.

FIG. 16 shows, for the exemplary family of alloys, that the value (1/(Al*Cr)) above 0.011 using atomic percent (in conjunction with higher Ta than ME16 and NF3, higher Nb than ME16 and NWC, and lower Cr than ME16, NF3, and NWC) achieves 1500° F. rupture life superior to those prior art alloys.

1350° F. creep (of 0.2%) tests illustrate trends with certain special elemental characteristics as found with statistical regressions: a positive trend with the $(Ta/Cr)^2$ content. PJ4 and PJ6 are outliers for 1350° F. creep.

Figure 17:
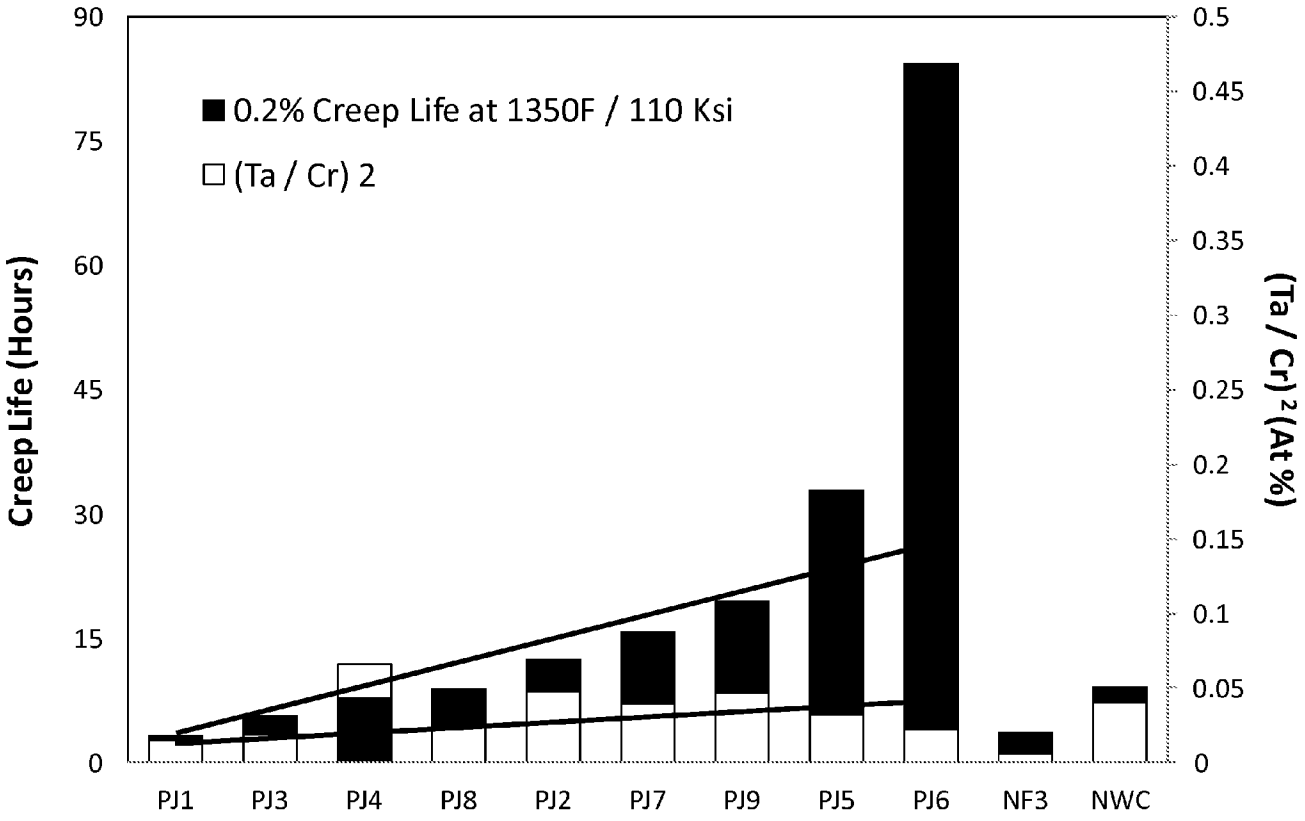
FIG. 17 is a dual bar graph of: 1350° F. (732° C.) creep life; and square of the ratio of tantalum to chromium contents using atomic percent.

FIG. 17 shows, for the exemplary family of alloys, that the value $(Ta/Cr)^2$ above 0.022 in atomic percent (in conjunction with higher Ta than ME16 and NF3, higher Nb than ME16 and NWC, and lower Cr than ME16, NF3, and NWC) achieves 1350° F. creep life superior to those prior art alloys. In alternative measurements, various of the above-characterized atomic percents may, alternatively, be characterized as weight percents based upon correlations for the various PJ1-PJ9 compositions in FIGS. 3 and 4.

The sum of the aluminum, tantalum, and chromium contents in the exemplary alloys was kept equivalent strictly for the purpose of aiding in statistical analysis as part of a designed experiment. Those skilled in the art would recognize that deviations from this sum would be possible without adversely affecting properties. For example, an exemplary range would be 17.7-24.2 atomic percent, more narrowly, 19.1-23.0.

Thus, an exemplary composition of matter, is characterized by a compositional range reflecting the values of contents above. Broadly, such range may account for different groups of those values (with broader values of others). Where certain minimum or maximum parameters are noted above, a range below may also include the opposite end estimated based upon projections from the present group and other alloys.

Other contents may be present in small amounts and/or impurity levels. One particular low quantity addition is Hf. From NWC it is believed that small amounts will not be adverse. Exemplary limits are in weight percent ≤0.50 (just over NWC) or, much lower, ≤0.05 or, intermediate ≤0.20.

Thus, in one characterization, the exemplary composition of matter comprises in combination, in atomic percent contents: a content of nickel as a largest content; 19.0-21.0 percent cobalt; 9.0-13.0 percent chromium; 1.0-3.0 percent tantalum; 0.9-1.5 percent tungsten; 7.0-9.5 percent aluminum; 0.10-0.25 percent boron; 0.09-0.20 percent carbon; 1.5-2.0 percent molybdenum; 1.1-1.5 percent niobium; 3.0-3.6 percent titanium; and 0.02-0.09 percent zirconium.

In further embodiments of narrower composition, said atomic percent contents are, more specifically, one or more of: 20.1-21.0 percent cobalt; 9.2-12.5 percent chromium; 1.4-2.5 percent tantalum; 0.94-1.3 percent tungsten; 7.1-9.2 percent aluminum; 0.14-0.24 percent boron; 0.09-0.20 percent carbon; 1.7-2.0 percent molybdenum; 1.15-1.30 percent niobium; 3.20-3.50 percent titanium; and 0.03-0.07 percent zirconium.

In further embodiments of narrower composition, said atomic percent contents are, more specifically, one or more of: 20.3-20.9 percent cobalt; 9.4-11.3 percent chromium; 1.8-2.5 percent tantalum; 0.9-1.0 percent tungsten; 7.9-9.2 percent aluminum; 0.15-0.23 percent boron; 0.09-0.16 percent carbon; 1.74-1.95 percent molybdenum; 1.20-1.26 percent niobium; 3.25-3.45 percent titanium; and 0.03-0.06 percent zirconium.

One or more embodiments have been described. Nevertheless, it will be understood that various modifications may be made without departing from the spirit and scope of the disclosure. For example, the operational requirements of any particular engine will influence the manufacture of its components. As noted above, the principles may be applied to the manufacture of other components such as impellers, shaft members (e.g., shaft hub structures), and the like. Accordingly, other embodiments are within the scope of the following claims.

What is claimed is:

1. A composition of matter, comprising in combination, in atomic percent contents:
a content of nickel as a largest content;
19.0-21.0 percent cobalt;
9.0-11.4 percent chromium;
1.4-3.0 percent tantalum;
0.9-1.5 percent tungsten;
7.0-9.5 percent aluminum;
0.10-0.25 percent boron;
0.09-0.20 percent carbon;
1.5-2.0 percent molybdenum;
1.1-1.5 percent niobium;
3.0-3.6 percent titanium; and
0.02-0.09 percent zirconium.

2. The composition of claim 1 in powder form.

3. A gas turbine engine turbine or compressor disk having the composition of claim 1.

4. The composition of claim 1 wherein said respective contents are:
20.3-20.9 percent cobalt;
9.4-11.3 percent chromium;
1.8-2.5 percent tantalum;
0.9-1.0 percent tungsten;
7.9-9.2 percent aluminum;
0.15-0.23 percent boron;
0.09-0.16 percent carbon;
1.74-1.95 percent molybdenum;
1.20-1.26 percent niobium;
4.25-3.45 percent titanium; and
0.03-0.06 percent zirconium.

5. The composition of claim 1 consisting essentially of said combination.

6. The composition of claim 1 comprising no more than 0.50 weight percent hafnium.

7. The composition of claim 1 comprising no more than 0.05 weight percent hafnium.

8. The composition of claim 1 wherein:
said content of nickel is at least 50 weight percent.

9. The composition of claim 1 wherein:
said content of nickel is 43-57 weight percent.

10. The composition of claim 1 wherein:
said content of nickel is 48-52 weight percent.

11. The composition of claim 1 having:
a value Ta above 1.45 using atomic percent.

12. The composition of claim 1 having:
a value (Cr/(Al*Ta)) below 1.0 using atomic percent.

13. The composition of claim 1 having:
a value (Cr/(Al*Ta)) below 0.53 using atomic percent.

14. The composition of claim 1 having:
a value $((Cr/Al)^2)$ less than 2.15 using atomic percent.

15. The composition of claim 1 wherein said respective contents are:
20.1-21.0 percent cobalt;
9.2-11.4 percent chromium;
1.4-2.5 percent tantalum;
0.94-1.3 percent tungsten;
7.1-9.2 percent aluminum;
0.14-0.24 percent boron;
0.09-0.20 percent carbon;
1.7-2.0 percent molybdenum;
1.15-1.30 percent niobium;
3.20-3.50 percent titanium; and
0.03-0.07 percent zirconium.

16. The composition of claim 15 having:
a value $(Ta/Cr)^2$ above 0.022 using atomic percent.

17. The composition of claim 15 having:
a value (1/(Al*Cr)) above 0.011 using atomic percent.
18. The composition of claim 15 having:
a value (Cr*Ta) above 17.5 using atomic percent.
19. The composition of claim 15 having:
a value (Cr/Ta) below 7.21 using atomic percent.
20. The composition of claim 15 having:
a value ((Al*Ta)/Cr) above 1.15 using atomic percent.
21. The composition of claim 15 having:
a value Ta above 1.67 using atomic percent.
22. The composition of claim 1 further comprising:
no more than 1.0 weight percent, individually, of every additional constituent, if any.
23. The composition of claim 22 further comprising:
no more than 1.0 weight percent, in total, of all additional constituents, if any.
24. A process for forming an article comprising:
compacting a powder having the composition of claim 1;
forging a precursor formed from the compacted powder; and
machining the forged precursor.
25. The process of claim 24 further comprising:
heat treating the precursor, at least one of before and after the machining, by heating to a temperature of no more than 1232° C. (2250° F.).
26. The process of claim 24 further comprising:
heat treating the precursor, at least one of before and after the machining, the heat treating effective to increase a characteristic γ grain size from a first value of about 10 μm or less to a second value of 20-120 μm.

* * * * *